US005455966A

United States Patent [19]

Tuin et al.

[11] Patent Number: 5,455,966

[45] Date of Patent: Oct. 3, 1995

[54] METHOD OF MANUFACTURING A DISPLAY WINDOW FOR A CATHODE RAY TUBE AND A CATHODE RAY TUBE

[75] Inventors: Hermanus N. Tuin; Maarten A. van Andel; Rudolf O. M. Löbel; Johannes H. M. Damen; Marcel Niestadt, all of Eindhoven, Netherlands

[73] Assignee: U.S. Philips Corporation, New York, N.Y.

[21] Appl. No.: 154,335

[22] Filed: Nov. 18, 1993

[30] Foreign Application Priority Data

Dec. 3, 1992 [EP] European Pat. Off. ..... 92203743

[51] Int. Cl.[6] ..... H01J 9/20

[52] U.S. Cl. ..... 445/52; 65/61

[58] Field of Search ..... 445/52; 427/64; 65/61; 313/461, 463, 474

[56] References Cited

U.S. PATENT DOCUMENTS

| | | | |
|---|---|---|---|
| 3,551,228 | 12/1970 | Meth . | |
| 3,813,568 | 5/1974 | Scott et al. | 313/363 |
| 3,873,343 | 3/1975 | Misumi et al. | 427/64 |
| 4,460,621 | 7/1984 | Pearlman | 427/64 |
| 4,731,558 | 3/1988 | Haisma et al. | 313/474 |
| 4,884,006 | 11/1989 | Prazak, III | 313/474 |

*Primary Examiner*—kenneth J. Ramsey
*Attorney, Agent, or Firm*—Paul R. Miller

[57] ABSTRACT

The inner surface of a cathode ray tube is roughened by blasting the surface with a suspension which comprises radiation particles, the inner surface being irradiated in such a manner that it satisfies the inequalities 0.05 μm<$R_a$<0.5 μm and $R_z$<4 μm and, preferably, 0.1 μm<$R_a$<0.2 μm. The reflection at such a surface is comparable to the reflection at an etched surface. The method in accordance with the invention is safer and less harmful to the environment.

12 Claims, 3 Drawing Sheets

METHOD OF MANUFACTURING A DISPLAY WINDOW FOR A CATHODE RAY TUBE AND A CATHODE RAY TUBE

The invention relates to a method of manufacturing a display window for a cathode ray tube, in which method the inner surface of the display window is treated to reduce reflection.

The invention also relates to a cathode ray tube whose inner surface is treated to reduce reflection.

BACKGROUND OF THE INVENTION

Cathode ray tubes are used, inter alia, in display devices, such as television receivers and computer monitors.

Light which is incident on the display window and reflected at the inner surface of the cathode my tube reduces the contrast of the image displayed and is disturbing.

A known method of reducing the reflection at a surface of a display window, such as the method described in U.S. Pat. No. 3,551,228, consists in subjecting the display window to an etch treatment in which the surface is roughened. However, this method requires very stringent safety measures and involves the production of many waste products which are harmful to the environment.

SUMMARY OF THE INVENTION

It is an object of the invention to provide a method of the type mentioned in the opening paragraph, which is less intricate and in which fewer environmentally harmful waste products are produced. The invention further aims at providing a cathode ray tube in which the degree of reflection is reduced.

To this end, the method in accordance with the invention is characterized in that the inner surface is blasted with a suspension of blasting particles in a liquid, under conditions such that after the blasting treatment the roughness parameters of the inner surface satisfy the inequalities 0.05 $\mu m < R_a < 0.5$ μm and $R_z < 4$ μm.

$R_a$ and $R_z$ are parameters as defined by DIN standard 4768.

The suspension of blasting particles does not degrade or degrades only slowly during the blasting process. Particles which are detached from the inner surface by the action of the blasting particles can be separated from the suspension or the suspension can be circulated, and in the latter case the detached particles will act as blasting particles after they have been circulated. Consequently, there is little waste material or spent suspension. The said waste material is not chemically aggressive and can be processed in a relatively simple manner. Unlike an etching liquid, the blasting suspension is a chemically non-aggressive substance. Thus, there are fewer safety problems. Preferably, water is used as the liquid.

For values of $R_a$ below 0.05 μm the reflection-reducing capacity of the inner surface is small. For values of $R_a$ above 0.5 μm there are imperfections in the phosphor patterns and/or matrix patterns provided on the inner surface, which imperfections adversely affect the picture quality. Preferably, the value of $R_a$ ranges between 0.1 and 0.2 μm, for example approximately 0.12 (± 0.02) μm. In the range between 0.1 and 0.2 μm, the reflection:reducing effect of the inner surface is satisfactory and phosphor and matrix patterns exhibit few imperfections. The range between 0.1 and 0.14 μm is particularly suitable if the cathode ray tube is provided with a matrix pattern. Preferably, $R_a$ is smaller than 1.5 μm. If $R_z$ is larger than this value, visible defects in the phosphor pattern or matrix pattern occur, in particular when a matrix pattern is used.

In an embodiment of the method in accordance with the invention, use is made of blasting particles having a grain size in the range between F800 and F1200 (which corresponds to an average particle size in the range between approximately 3 μm and 7 μm), for example F1000 (corresponding to an average particle size of 4–5 μm).

If coarser grains are used it is difficult to prevent that $R_a$ and/or $R_z$ become larger than 1 and 4 μm, respectively, which adversely affects the picture quality. The use of finer grains requires a long processing time. The blasting particles consist largely of, for example, $Al_2O_3$.

The invention also provides a cathode ray tube having a display window with an blasted inner surface whose roughness satisfies the inequalities 0.05 $\mu m < R_a < 0.5$ μm and $R_z < 4$ μm. Preferably, the inner surface satisfies the inequality 0.1 $\mu m < R_a < 0.2$ μm, $R_a$ being for example approximately equal to 0.12 (±0.02) μm.

BRIEF DESCRIPTION OF THE DRAWING FIGURES

These and other aspects of the invention will be described in greater detail by means of an exemplary embodiment and with reference to the accompanying drawing, in which FIG. 1 shows a cathode ray tube.

Figure 7:
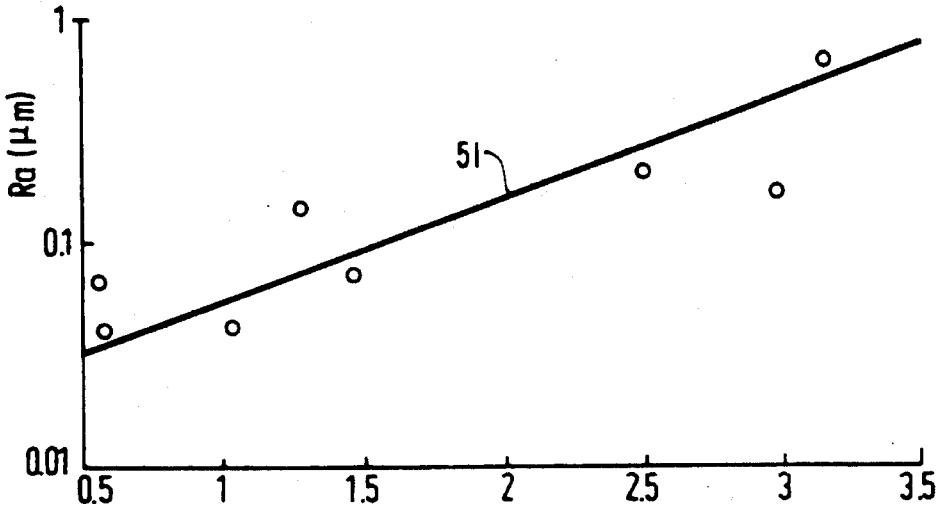

FIG. 7 graphically shows the effect of $R_a$ on the reflection.

Figure 8A:
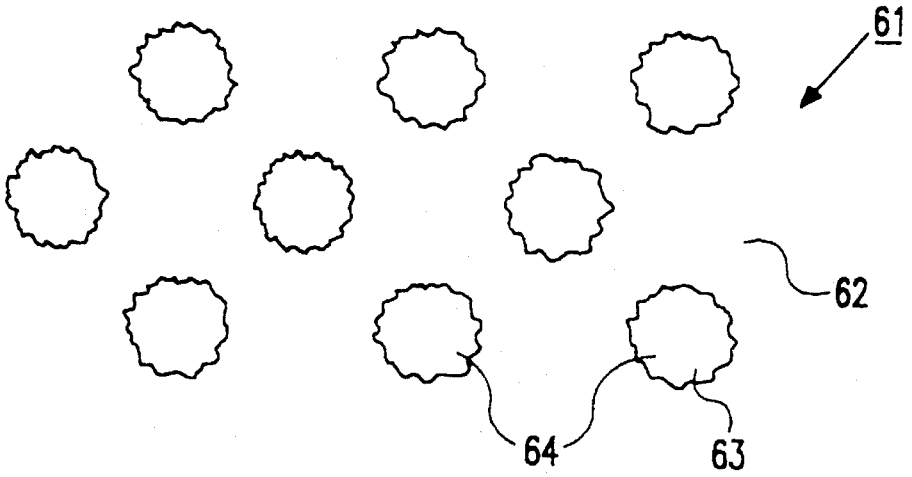
Figure 8B:
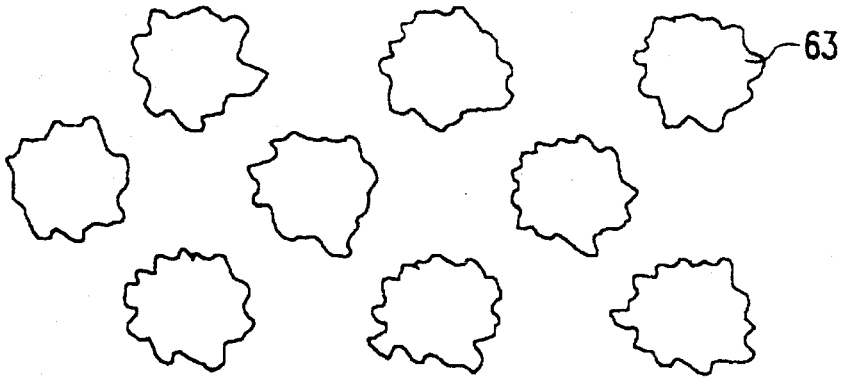
Figure 8C:
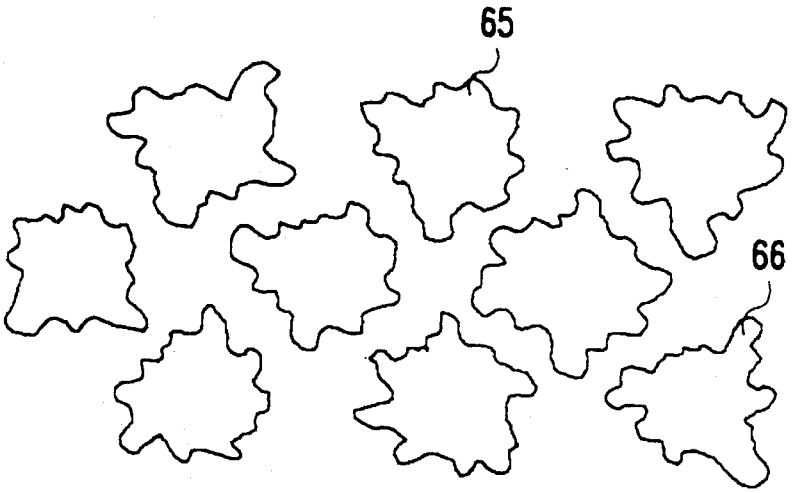

FIGS. 8A, 8B and 8C diagrammatically show the effect of $R_a$ and $R_z$ on the shape of a matrix pattern.

The Figures are diagrammatic and not drawn to scale, and corresponding parts generally bear the same reference numerals.

DESCRIPTION OF THE INVENTION

Figure 1:
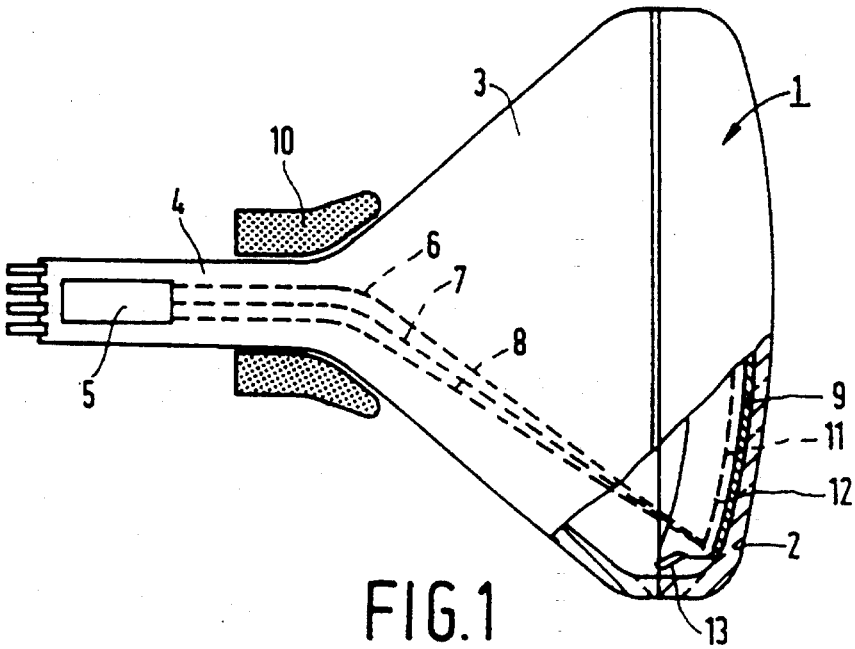

FIG. 1 is a sectional view of a cathode ray display device, in this example a colour cathode ray tube, having an evacuated envelope 1 comprising a substantially rectangular display window 2, an enveloping portion 3 and a neck 4. In the neck there is provided an electrode system 5 for generating, in this case, three electron beams 6, 7 and 8. In this example, the electron beams are generated in one plane (the plane of the drawing) and are directed to an electroluminescent display screen 9 provided on the inside of the display window, where the display screen comprises a phosphor pattern which consists of a large number of phosphor elements luminescing in red, green and blue, and a matrix pattern. The phosphor elements may be, for example, in the form of dots or lines. The matrix pattern, which consists for example of a light-absorbing substance, is largely situated between the phosphor elements. On their way to the display screen 9, the electron beams 6, 7 and 8 are deflected across the display screen 9 by means of a deflection unit 10 and pass through a colour selection electrode 11 which is arranged in front of the display screen 9 and which comprises a thin plate having apertures 12. The three electron beams 6, 7 and 8 pass through the apertures 12 of the colour selection electrode 11 at a small angle with each other, and consequently, each electron beam is incident on phosphor elements of only one colour. The colour selection electrode 11 is suspended in front of the display screen by means of suspension means 13.

Figure 2:
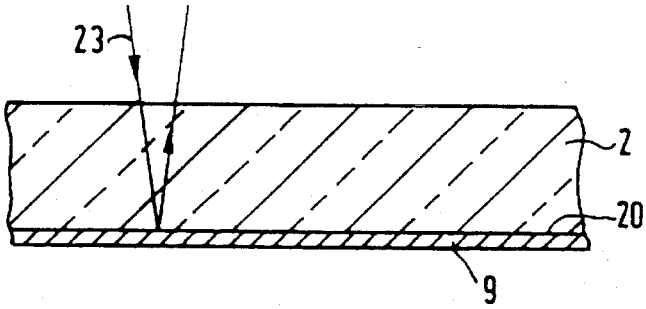
FIG. 2 shows a detail of FIG. 1.

FIG. 2 is a sectional view of a detail of FIG. 1. The display screen 9 is provided on the inner surface 20 of the display window 2. Incident light 23 is partially reflected at the inner surface 20 of the display window.

Figure 3:
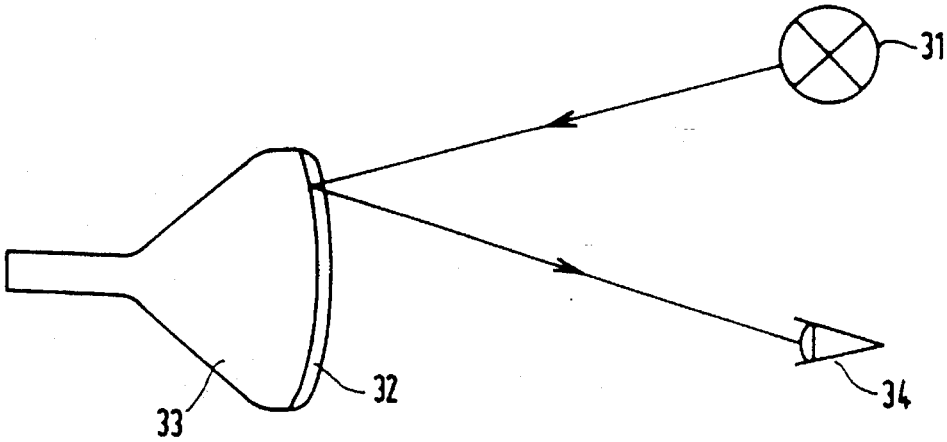
FIG. 3 shows the disturbing effect of reflections at the inner surface of the cathode ray tube.

FIG. 3 illustrates the disturbing effect of reflection at the inner surface 20. The light of a light source (for example a lamp 31 or sunlight incident through a window) is incident on the display window 32 of a display device 33 and is partially reflected at the inner surface 20 towards viewer 34. The reflected light reduces the contrast of the image displayed. Unless stated otherwise, the term "reflection" is to be understood to mean within the scope of the invention, specular reflection.

The intensity of the reflected light depends on the reflection at the inner surface 20.

The reflection at a surface of a display window can be reduced in known manner by etching the surface. Customarily, the surface is etched with a very strong acid, for example a HF—(approximately 10–20% by weight) and sulphuric acid—(approximately 35% by weight) solution in water. The etching liquid used is a very aggressive substance since it attacks glass, which is a very corrosion-resistant material, relatively rapidly. Consequently, the equipment used and the safety procedures must satisfy very high requirements during etching. If the etching liquid contacts, for example, the skin of a person, it may inflict very serious and even lethal injuries. Also the gases emitted by such an etching liquid are very aggressive. The waste material of such an etching process is harmful to the environment. It is an object of the invention to provide a method in which one or more of the above problems are reduced.

Figure 4:
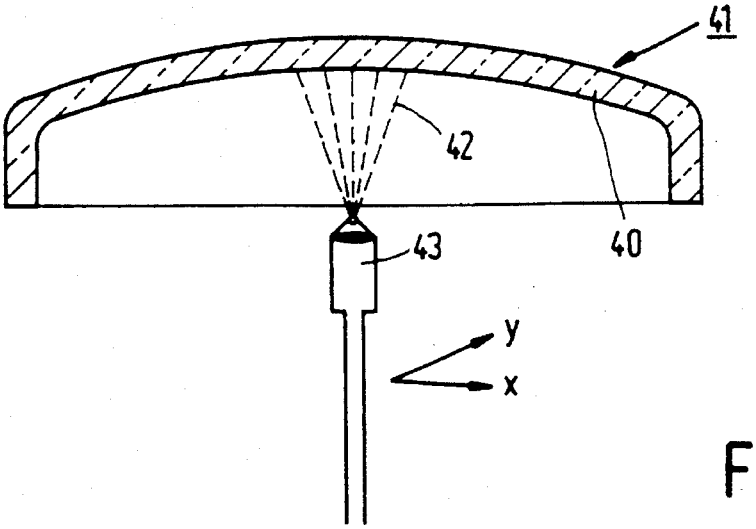
FIG. 4 illustrates an embodiment of the method in accordance with the invention.
Figure 5:
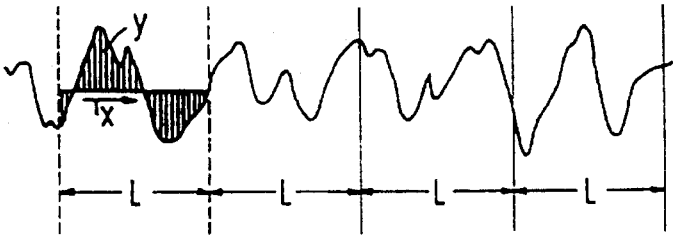
FIGS. 5 and 6 illustrate the roughness parameters $R_a$ and $R_z$.
Figure 6:
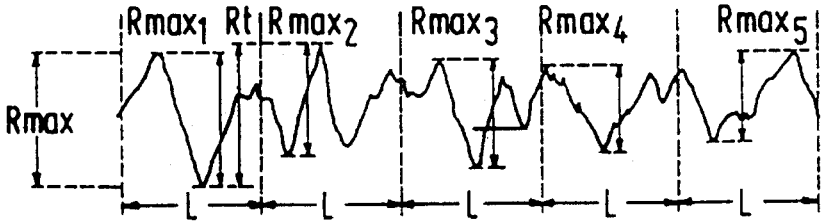

FIG. 4 shows an embodiment of the method in accordance with the invention. The inner surface 40 of the display window 41 is blasted by particles; in this example a suspension of $Al_2O_3$ particles (grain size F1000) in water is ejected from a nozzle 43 onto the inner surface at a pressure of approximately 6–9 atmosphere for approximately 10 minutes. In the suspension, the ratio of $Al_2O_3$ particles to water is approximately in the range from 1:10 to 1:20. In this example, the nozzle is moved in the x and y directions during the radiation process to obtain a uniformly treated inner surface. Irradiation of the inner surface is continued until the roughness parameters of the inner surface meet the conditions that the roughness parameters are $0.05\ \mu < R_a < 0.5\ \mu m$ and $R_z < 4$. The roughness parameters $R_a$ and $R_z$ are defined in accordance with DIN-standard 4768 and can be measured by means of a roughness meter, for example the "Perthometer" M4P which is available from the firm of Perthen. FIGS. 5 and 6 illustrate the definitions of $R_a$ and $R_z$:

$$R_a=(1/L)\int_o^L |y(x)|dx$$

$$R_z=(R_{max1}+R_{max2}+R_{max3}+R_{max4}+R_{max5})/5$$

where L is the so-called "sampling length" (for example approximately 1.25 mm). These roughness parameters correspond to the roughness parameters as defined in US-standard ANSIB 46.1 and UK standard Bs 1134. Comparative tests, conducted within the framework of the invention, in which the inner surface of display windows was treated by blasting the inner surface with a dry beam of powder particles or by grinding with powders, showed that the reflection at the inner surface exhibits inhomogeneities. Inhomogeneities are, for example, scratch patterns or parts of the surface having a reflection coefficient which differs relatively substantially from the average value. Such inhomogeneities are visible, in particular, at the edges of the inner surface and give the display window a stained appearance.

After blasting the inner surface with the suspension, the surface can be washed with an approximately 0.3% by weight (or less) HF-solution to remove any impurities. The roughness of the surface is not or only slightly influenced by such a washing treatment. Subsequently, the display window is dried in a known manner and provided with, for example, a matrix pattern and a phosphor pattern. The reflection of an inner surface of a display window irradiated in accordance with the invention is comparable to the reflection of an etched inner surface.

FIG. 7 diagrammatically and graphically shows the effect of $R_a$ on the reflection. $R_a$ is plotted on the vertical axis and the logarithm of the quotient of light reflected at the outer surface at an angle of 45° and of light reflected at the inner surface at an angle of 45° is plotted on the horizontal axis. For carrying out these tests, the outer surface, unlike the inner surface, is not subjected to a treatment. Measurements are indicated by small circles, line 51 represents the average value. FIG. 7 shows that for values of $R_a$ smaller than 0.05 μm, the reflection decreases only by a factor of 2 or less. For values in excess of 0.05 μm, the reflection decreases by a factor of more than 2. FIGS. 8A, 8B and 8C show the effect of $R_a$ and $R_z$ on the shape of the matrix pattern. FIG. 8A shows a matrix pattern 61 on an inner surface for which it holds that $R_a$~0.12 μm and $R_z$<4 μm. The matrix pattern consists of a black matrix 62 having apertures 63. Phosphor elements 64 are present in the apertures 63. The edges of the apertures exhibit some small irregularities, however, they are not disturbingly visible in the displayed image.

FIG. 8B shows the effect of a large $R_a$, for example in excess of 0.5 μm. The edges of the apertures 63 exhibit large irregularities which adversely affect the image displayed.

FIG. 8C shows the effect of a large value of $R_z$, for example in excess of 4 μm. A large value of $R_z$ means that there are apertures (65, 66) whose edges are very irregularly shaped. This adversely affects the picture quality.

Notably, there is a chance that apertures completely or partly merge with each other. As a result, phosphor elements are no longer or hardly separated from each other by the matrix pattern.

Preferably, the value of $R_a$ ranges between 0.1 and 0.2 μm and $R_z$ is smaller than 1.5 μm. In this case, the edges of the apertures in the matrix pattern are very regularly shaped.

It will be obvious that within the scope of the invention many variations are possible to those skilled in the art. The invention is not limited to the example given herein. For example, the radiation operation may be carried out at an increased pressure, resulting in a reduction of the processing time per window. It is alternatively possible to use an arrangement comprising more than one nozzle, for example a row of nozzles. As a result, the processing time per window is further reduced.

We claim:

1. A method of manufacturing a display window for a cathode ray tube comprising the step of only blasting the inner surface of the display window with a suspension of blasting particles in a liquid to form said inner surface with roughness parameters $R_a$ and $R_z$ having values within the ranges of 0.05 μm<$R_a$<0.5 μm and $R_z$<4 μm.

2. A method according to claim 1, wherein said roughness parameter $R_a$ ranges between 0.1 and 0.2 μm.

3. A method according to claim 2, wherein said roughness parameter $R_a$ is approximately 0.12±0.02 μm.

4. A method according to claim 2, wherein said roughness parameter $R_z$ is smaller than 1.5 μm.

5. A method according to claim 1, wherein said roughness parameter $R_a$ is approximately 0.12±0.02 μm.

6. A method according to claim 1, wherein said roughness parameter $R_z$ is smaller than 1.5 μm.

7. A method according to claim 1, wherein said blasting particles have a grain size range from F800 to F1200.

8. A method according to claim 1, wherein after said step of blasting, a further step of washing said inner surface is carried out.

9. A method according to claim 1, wherein a further step of providing said inner surface with a matrix pattern is carried out.

10. A method according to claim 1, wherein said step of blasting is carried out by forming said suspension of blasting particles in a liquid and ejecting said suspension from a nozzle onto said inner surface under pressure for a period of time until said roughness parameters are achieved.

11. A method according to claim 10, wherein said nozzle is moved over said inner surface to uniformly treat said inner surface.

12. A method according to claim 10, wherein said pressure is in the range of approximately 6 to 9 atmospheres.

* * * * *